US007005989B2

(12) United States Patent
Benoit et al.

(10) Patent No.: US 7,005,989 B2
(45) Date of Patent: Feb. 28, 2006

(54) EAS MARKER

(75) Inventors: James C. Benoit, Needham, MA (US); John R. Franks, Hopkinton, MA (US); Charles L. Deschenes, North Attleboro, MA (US)

(73) Assignee: Avery Dennison Corporation, Pasadena, CA (US)

( * ) Notice: Subject to any disclaimer, the term of this patent is extended or adjusted under 35 U.S.C. 154(b) by 84 days.

(21) Appl. No.: 10/312,786

(22) PCT Filed: Jun. 25, 2001

(86) PCT No.: PCT/US01/41134

§ 371 (c)(1),
(2), (4) Date: Sep. 2, 2003

(87) PCT Pub. No.: WO02/03343

PCT Pub. Date: Jan. 10, 2002

(65) Prior Publication Data

US 2004/0051640 A1 Mar. 18, 2004

Related U.S. Application Data

(60) Provisional application No. 60/215,088, filed on Jun. 29, 2000, provisional application No. 60/230,771, filed on Sep. 7, 2000.

(51) Int. Cl.
*G08B 13/14* (2006.01)

(52) U.S. Cl. ..... 340/572.5; 340/572.1; 340/572.8; 340/572.9; 340/568.1; 340/571

(58) Field of Classification Search ..... 340/572.5, 340/572.1, 572.8, 572.9, 568.1, 571
See application file for complete search history.

(56) References Cited

U.S. PATENT DOCUMENTS

| | | | | |
|---|---|---|---|---|
| 3,974,581 | A | 8/1976 | Martens et al. | 340/572.7 |
| 4,510,489 | A | 4/1985 | Anderson, III et al. | 340/572.1 |
| 4,510,490 | A | 4/1985 | Anderson, III et al. | 340/572.1 |
| 4,603,326 | A | 7/1986 | Freed | 340/572.8 |
| 4,622,543 | A | 11/1986 | Anderson, III et al. | 340/572.1 |
| 4,774,504 | A | 9/1988 | Hartings | 340/572.5 |
| 5,351,033 | A | 9/1994 | Liu et al. | 340/572.6 |

(Continued)

*Primary Examiner*—Toan N. Pham
(74) *Attorney, Agent, or Firm*—Kriegsman & Kriegsman

(57) ABSTRACT

EAS marker, in one embodiment, comprises a self-lockable loop fastener. The self-lockable loop fastener comprises an elongated strap having a first end and a second end, the second end being provided with a plurality of teeth. The self-lockable loop fastener also comprises a paddle disposed at the first end of the strap. The paddle includes a recess and a locking head. The second end of the strap is insertable into, but not through, the locking head, the locking head having a tang for lockably engaging the teeth in such a way as to prevent withdrawal of the strap from the locking head and thereby forming a locked loop of fixed size. The EAS marker also includes a resonator disposed within the recess of the paddle for emitting, when armed, a response signal in response to an interrogation signal transmitted by an EAS system, a biasing element disposed within the recess and positioned relative to the resonator so that, when the biasing element is magnetized, the resonator is armed; a separator disposed within the recess between the resonator and the biasing element for physically separating the resonator and the biasing element; and a cover secured to the paddle to encapsulate the resonator, the separator and the biasing element within the recess and to prevent access to and tampering with the tang and the locking head.

31 Claims, 18 Drawing Sheets

U.S. PATENT DOCUMENTS 5,357,240 A 10/1994 Sanford et al. ..... 340/572.8
5,426,419 A * 6/1995 Nguyen et al. ..... 340/572.9
5,469,140 A 11/1995 Liu et al. ..... 340/551
5,494,550 A 2/1996 Benge ..... 156/268
5,495,230 A 2/1996 Lian ..... 340/572.1
5,499,015 A 3/1996 Winkler et al. ..... 340/572.2
5,565,849 A 10/1996 Ho et al. ..... 340/572.6
5,568,125 A 10/1996 Liu ..... 340/551
5,631,631 A 5/1997 Deschenes ..... 340/572.1
5,676,767 A 10/1997 Liu et al. ..... 148/108
5,717,382 A 2/1998 Cooper ..... 340/572.8
5,949,336 A 9/1999 Deschenes et al. ..... 340/572.8
5,969,613 A 10/1999 Yeager et al. ..... 340/572.9
6,025,781 A 2/2000 Deschenes ..... 340/572.8
6,064,306 A 5/2000 Deschenes et al. ..... 340/572.8
6,067,016 A 5/2000 Deschenes et al. ..... 340/572.8
6,188,320 B1 * 2/2001 Kolton et al. ..... 340/572.9

* cited by examiner

EAS MARKER

CROSS-REFERENCE TO RELATED APPLICATIONS

The present application claims the benefit under 35 U.S.C. § 119(e) of U.S. Provisional Patent Application Ser. No. 60/215,088, filed Jun. 29, 2000, and of U.S. Provisional Patent Application Ser. No. 60/230,771, filed Sep. 7, 2000, both of which are incorporated herein by reference.

BACKGROUND OF THE INVENTION

The present invention relates generally to electronic article surveillance (EAS) systems and more particularly to a novel EAS marker for use in an EAS system.

The problem of protecting articles of merchandise and the like against theft has been the subject of numerous technical approaches. One such type of approach has been to attach to the article an electronic tag or marker that is adapted to trigger an alarm or the like if the article of merchandise is moved beyond a predetermined location and the electronic marker has not been deactivated or removed from the article of merchandise. In the aforementioned type of approach, a transmitting apparatus and a receiving apparatus are typically situated on opposite sides of a passageway leading to an exit of the premises being protected, the transmitting apparatus and the receiving apparatus together defining an interrogation zone. The transmitting apparatus is typically used to transmit over the interrogation zone an interrogation signal that is recognizable by the EAS marker and that causes the EAS marker, if activated, to emit a response signal. The receiving apparatus is typically used to detect the presence of a response signal from an activated EAS marker located within the interrogation zone. The detection by the receiving apparatus of a response signal indicates that the EAS marker has not been removed or deactivated and that the article bearing the marker may not have been paid for or properly checked out. Typically, the detection of such a response signal by the receiving apparatus triggers an alarm.

Several different types of EAS markers have been disclosed in the literature and are in use. In one type of EAS marker, the functional portion of the marker consists of either an antenna and diode or an antenna and capacitors forming a resonant circuit. When placed in an electromagnetic interrogation zone created by the transmitting apparatus, the antenna-diode marker generates harmonics of the interrogation frequency in a receiving antenna in the receiving apparatus; the resonant circuit marker causes an increase in absorption of the transmitted signal so as to reduce the signal in the receiving apparatus. The detection of the harmonic or signal level change indicates the presence of the marker in the interrogation zone. With this type of system, the marker is not amenable to deactivation and, therefore, must be removed from the article of merchandise at the time of purchase so as not to trigger the alarm when the merchandise is removed from the store.

Examples of the aforementioned type of EAS marker are disclosed in U.S. Pat. No. 3,974,581, inventors Martens et al., which issued Aug. 17, 1976, and U.S. Pat. No. 4,774,504, inventor Hartings, which issued Sep. 27, 1988, both of which are incorporated herein by reference.

Another type of EAS marker includes a magnetostrictive element, also referred to in the art as "a resonator." Typically, the resonator is in the form of a ribbon-shaped length of an amorphous magnetostrictive ferromagnetic material. Said type of EAS marker also typically includes a biasing magnetic element. The resonator is fabricated such that it is mechanically resonant at a predetermined frequency when the biasing element has been magnetized to a certain level and the resonator is brought into an interrogation zone consisting of an AC magnetic field of the predetermined frequency. In use, the biasing element is activated, i.e., magnetized, and the marker is brought into the interrogation zone, thereby causing the resonator to mechanically resonate at the predetermined frequency. This resonant signal radiated by the resonator is then detected by circuitry provided in the receiving apparatus. By demagnetizing the biasing element, the bias is removed from the resonator; accordingly, when subjected to the AC magnetic field, the resonator no longer resonates to produce a detectable magnetic field. The marker can thus be activated and deactivated by magnetizing and demagnetizing the biasing element.

Examples of the aforementioned magnetomechanical type of EAS marker are disclosed in the following U.S. patents, all of which are incorporated herein by reference: U.S. Pat. No. 4,510,489, inventors Anderson, III et al., which issued Apr. 9, 1985; U.S. Pat. No. 4,510,490, inventors Anderson, III et al., which issued Apr. 9, 1985; U.S. Pat. No. 4,622,543, inventors Anderson, III et al., which issued Nov. 11, 1986; U.S. Pat. No. 5,351,033, inventors Liu et al., which issued Sep. 27, 1994; U.S. Pat. No. 5,469,140, inventors Liu et al., which issued Nov. 21, 1995; U.S. Pat. No. 5,495,230, inventor Lian, which issued Feb. 27, 1996; U.S. Pat. No. 5,568,125, inventor Liu, which issued Oct. 22, 1996; U.S. Pat. No. 5,676,767, inventors Liu et al., which issued Oct. 14, 1997; U.S. Pat. No. 5,499,015, inventors Winkler et al., which issued Mar. 12, 1996; U.S. Pat. No. 5,565,849, inventors Ho et al., which issued Oct. 15, 1996; U.S. Pat. No. 5,494,550, inventor Benge, which issued Feb. 27, 1996; U.S. Pat. No. 5,357,240, inventors Sanford et al., which issued Oct. 18, 1994; and U.S. Pat. No. 6,067,016, inventors Deschenes et al., which issued May 23, 2000.

Another example of the aforementioned magnetomechanical EAS marker, which type is also one of the most widely used types of magnetomechanical EAS markers, comprises a plastic sheet material (e.g., styrene) which carries a heat seal coating. Said plastic sheet material is subjected to a thermoforming process to form a rectangular box-like housing with an open top bordered by a surrounding flange. A resonator is inserted into the housing through the open top, the resonator being curved slightly downwardly about its longitudinal axis. A clear, flexible, plastic sheet (e.g., polyethylene), often referred to as "lidstock," is placed over the top of the housing and is heat-sealed or laminated to the border flange so as to close the housing, thereby encasing the resonator therewithin. Due to the aforementioned process of laminating the lidstock to the housing, a downward curve or "pillow" is typically formed in the midsection of the lidstock, said pillow delimiting upward movement of the resonator within the housing. A double-sided adhesively-coated carrier sheet is laid down over the lidstock and is secured to the border flange of the housing. A biasing magnetic element is secured to the underside of the carrier sheet. A peelable liner is applied to the top surface of the carrier sheet. When using the marker, the liner is peeled from the carrier and the exposed adhesive surface thereof is pressed against a desired article of merchandise, thereby securing the article and the marker together. Typically, the marker is manufactured as part of a batch using a multi-stationed, turntable-containing apparatus analogous to that described in U.S. Pat. No. 5,357,240. A commercial embodiment of the aforementioned marker is sold by Sensormatic Electronics Corporation (Deerfield Beach, Fla.) under the "UltraMax" trademark.

In U.S. Pat. No. 5,949,336, inventors Deschenes et al., which issued Sep. 7, 1999, and which is incorporated herein by reference, there is disclosed a fastener assembly for use in tagging an article of commerce and in detecting the unauthorized removal of the article from a store or other business establishment. The fastener assembly comprises a plastic fastener comprising an elongated filament having a first end and a second end, a transverse bar disposed at the first end of the elongated filament and a paddle disposed at the second end of the elongated filament. The paddle is shaped to include a recess. The fastener assembly also comprises an electronic article surveillance (EAS) security device which is disposed within the recess of the paddle. A cover is mounted over the recess so as to trap the security device within the paddle. A method of manufacturing the fastener assembly can be accomplished by continuously molding a length of fastener stock to form a plastic fastener having a recess formed therein, disposing a security device within the recess of the plastic fastener and mounting a cover over the recess so as to trap the security device within the fastener.

Other documents of interest include the following U.S. patents, all of which are incorporated herein by reference: U.S. Pat. No. 5,631,631, inventor Deschenes et al., which issued May 20, 1997; U.S. Pat. No. 5,717,382, inventor Cooper, which issued Feb. 10, 1998; U.S. Pat. No. 4,603,326, inventor Freed, which issued Jul. 29, 1986; U.S. Pat. No. 6,025,781, inventor Deschenes, which issued Feb. 15, 2000; and U.S. Pat. No. 6,064,306, inventors Deschenes et al., which issued May 16, 2000.

SUMMARY OF THE INVENTION

It is an object of the present invention to provide a novel EAS marker for use in an EAS system.

It is another object of the present invention to provide an EAS marker as described above that is incorporated into a fastener attachable to articles of commerce.

According to a first aspect of the present invention, there is provided an EAS marker comprising (a) a plastic fastener, said plastic fastener comprising (i) an elongated flexible filament having a first end and a second end, (ii) a transverse bar disposed at said first end, (iii) a paddle disposed at said second end; (b) a cover secured to said paddle, said cover and said paddle jointly defining a compartment; (c) a resonator disposed within said compartment for emitting, when armed, a response signal in response to an interrogation signal transmitted by an EAS system; (d) a biasing element disposed within said compartment and positioned relative to said resonator so that, when said biasing element is magnetized, said resonator is armed; and (e) a separator disposed within said compartment between said resonator and said biasing element for physically separating said resonator and said biasing element.

According to a second aspect of the present invention, there is provided a clip of EAS markers, said clip comprising a pair of EAS markers as described above and a severable connector extending from the second end of the first transverse bar of the first EAS marker to the first end of the second transverse bar of the second EAS marker.

According to a third aspect of the present invention, there is provided an EAS marker comprising (a) a cable tie, said cable tie comprising (i) an elongated strap having a first end and a second end, said elongated strap being shaped to include a locking head at said first end, said locking head having a channel through which said second end of said elongated strap may be inserted and having a tang for lockably engaging said elongated strap, and (ii) a paddle coupled to said locking head; (b) a cover secured to said paddle, said cover and said paddle jointly defining a compartment; and (c) an EAS device disposed within said compartment.

According to a fourth aspect of the present invention, there is provided an EAS marker comprising (a) a self-lockable loop fastener, said self-lockable loop fastener comprising (i) an elongated strap having a first end and a second end, said second end being provided with an engageable member, (ii) a paddle disposed at said first end of said elongated strap, said paddle having a locking head, said second end of said elongated strap being insertable into, but not through, said locking head, said locking head having means for lockably engaging said engageable member on said elongated strap so as to form a locked loop of fixed size; (b) a cover secured to said paddle, said cover and said paddle jointly defining a compartment; and (c) an EAS device disposed within said compartment.

The present invention is also directed to a cable tie, said cable tie comprising (a) an elongated strap having a first end and a second end, said elongated strap being shaped to include a locking head at said first end, said locking head having a channel through which said second end of said elongated strap may be inserted and having a tang for lockably engaging said elongated strap, and (b) a paddle coupled to said locking head.

The present invention is further directed to a self-lockable loop fastener, said self-lockable loop fastener comprising (a) an elongated strap having a first end and a second end, said second end being provided with an engageable member, and (b) a locking head coupled to said first end of said elongated strap, said second end of said elongated strap being insertable into, but not through, said locking head, said locking head having means for lockably engaging said engageable member on said elongated strap so as to form a locked loop of fixed size.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
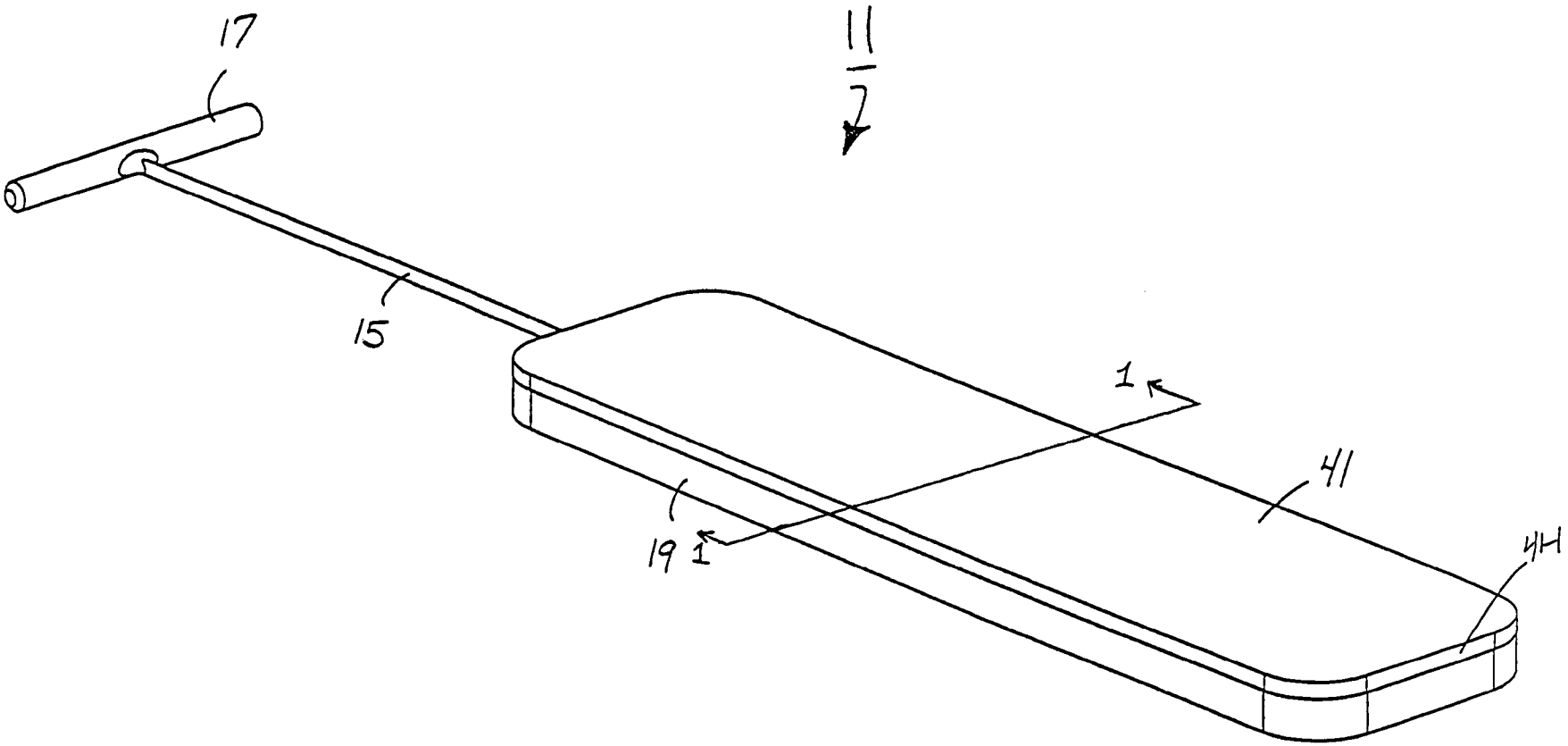
FIG. 1 is a top perspective view of a first embodiment of an EAS marker constructed according to the teachings of the present invention.
Figure 2:
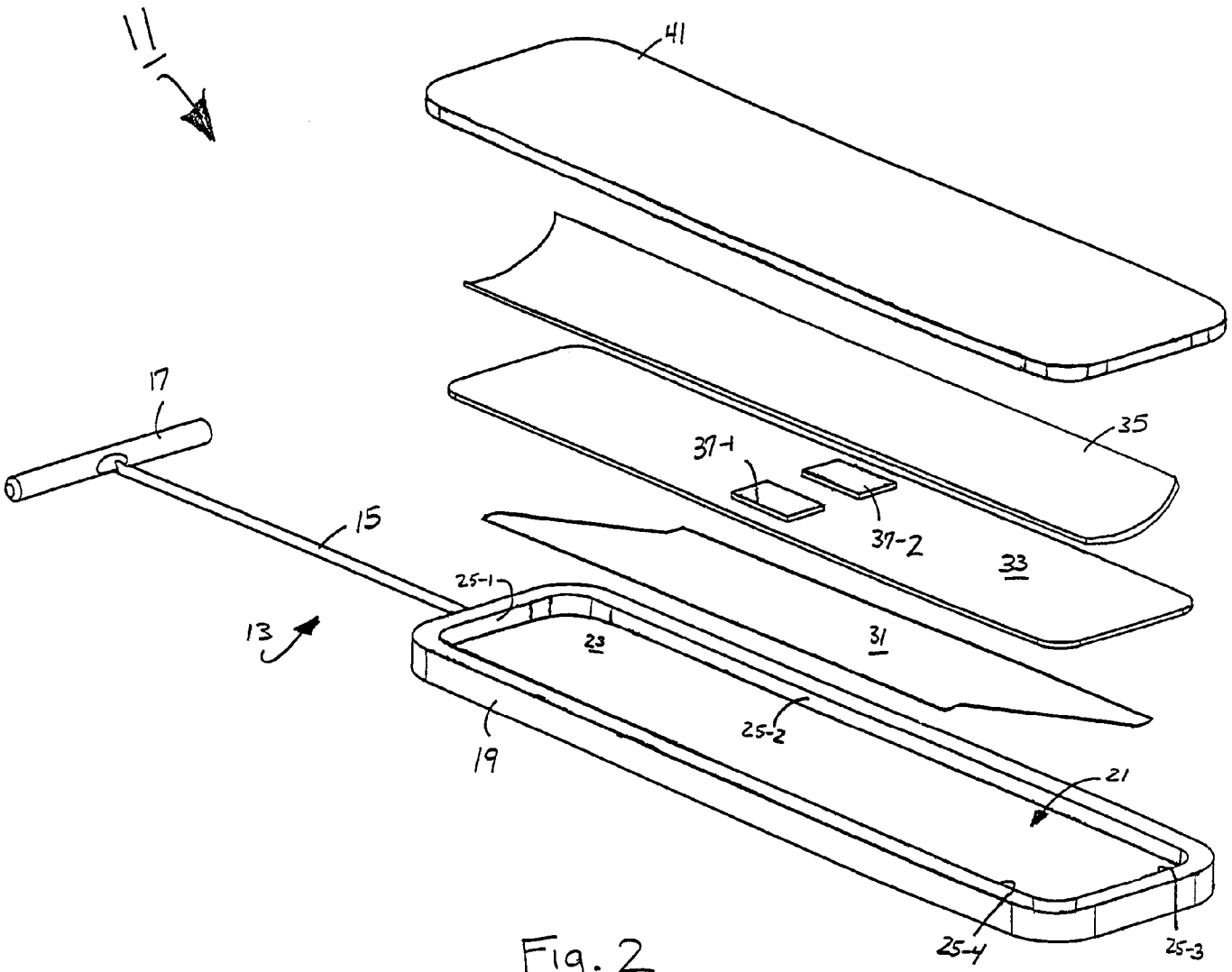
FIG. 2 is an exploded perspective view of the EAS marker of FIG. 1.
Figure 3:
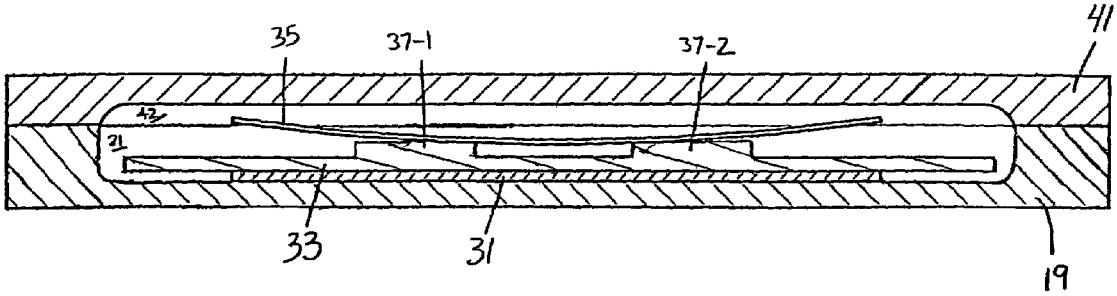
FIG. 3 is a section view of the EAS marker of FIG. 1 taken along line 1—1.

Referring now to FIGS. 1 through 3, there are shown various views of a first embodiment of an EAS marker constructed according to the teachings of the present invention, said EAS marker being represented generally by reference numeral 11.

Figure 4:
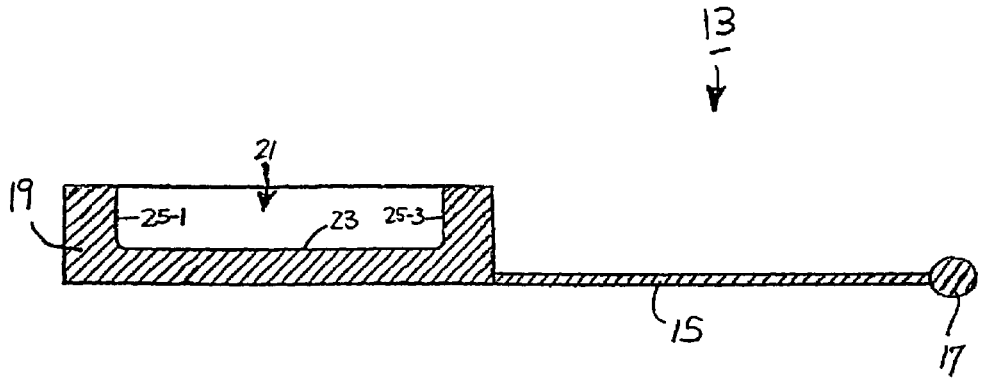
FIG. 4 is a longitudinal section view of the plastic fastener shown in FIG. 1.

Marker 11 comprises a plastic fastener 13 (plastic fastener 13 being shown separately in FIG. 4). Plastic fastener 13, which may be made, for example, by injection molding, comprises an elongated flexible filament 15 having a first end and a second end. A transverse bar 17 is disposed at the first end of filament 15, and a paddle 19 is disposed at the second end of filament 15. Paddle 19 is a trough-shaped member shaped to include a rectangular recess 21 having an open top and being bounded by a bottom wall 23 and four side walls 25-1 through 25-4.

Marker 11 also comprises a biasing element 31, a separator 33, and a resonator 35, all of which are disposed within recess 21, with biasing element 31 being positioned directly on top of bottom wall 23, separator 33 being positioned directly on top of biasing element 31 and resonator 35 being positioned directly on top of separator 33. Biasing element 31 and resonator 35 are preferably conventional in structure and composition and may be, for example, similar to biasing element 51 and resonator 41, respectively, of U.S. Pat. No. 6,067,016. Separator 33 is similar in structure and composition to separator 83 of U.S. Pat. No. 6,067,016.

Marker 11 further comprises a cover 41, cover 41 being secured to paddle 19 in such a way as to securely encapsulate within recess 21 the combination of biasing element 31, separator 33 and resonator 35. Cover 41, which is preferably made of a molded material similar in composition to plastic fastener 13, is preferably secured to paddle 19 by ultrasonic welding. Alternatively, cover 41 may be secured to paddle 19 by any other suitable method, such as by a suitable adhesive, by a frictional or interlocking fit or the like. Cover 41 may be flat on its inside surface or, as in the present embodiment, may be a trough-shaped member shaped to include a shallow recess 42 (as seen best in FIG. 3) having an open bottom, recess 42 being similar in shape to recess 21. Cover 41 and paddle 19 are preferably made of a sufficiently rigid material to protect the contents of recess 21 since biasing element 31, separator 33 and resonator 35 are encapsulated only by cover 41 and paddle 19.

Figure 5:
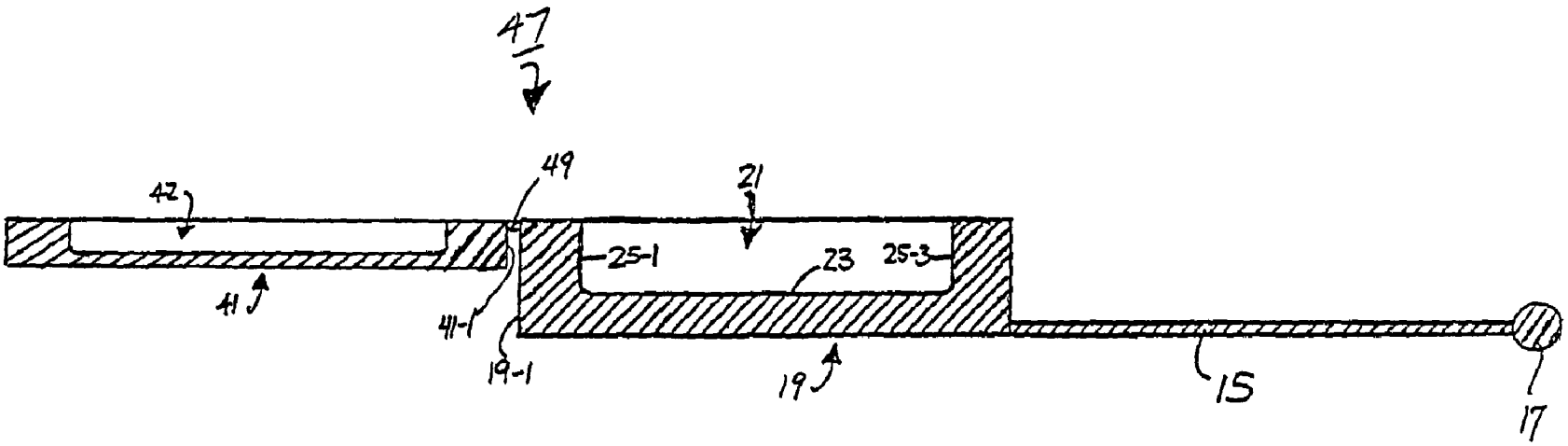
FIG. 5 is a longitudinal section view of an alternate embodiment of the plastic fastener shown in FIG. 4.

Although, in the present embodiment, cover 41 and paddle 19 are shown as two separate pieces which are secured in the manner described above, it can readily be appreciated that cover 41 and paddle 19 could be formed as a unitary structure, with end 41-1 of cover 41 being hingedly interconnected to the end of paddle 19 distal to transverse bar 17 (as illustrated by fastener 47 shown in FIG. 5 wherein end 41-1 of cover 41 is hingedly interconnected to end 19-1 of paddle 19 by a hinge 49). In this manner, cover 41 may be pivoted away from paddle 19 while biasing element 31, separator 33 and resonator 35 are loaded into recess 21; thereafter, cover 41 may be pivoted into contact with paddle 19 and secured thereto in the manner described above.

It should also be understood that fastener 13 could be modified so that cover 41, and not paddle 19, is disposed at the second end of filament 15, with paddle 19 being a separate piece from fastener 13 that is later secured to cover 41 in the manner described above or with paddle 19 and cover 41 being hingedly interconnected, as in the case of fastener 47.

Marker 11 is intended to be attached to articles of commerce in the same manner as a typical plastic fastener and, thereafter, is intended to be used in the same fashion as a conventional magnetomechanical EAS marker.

Figure 6:
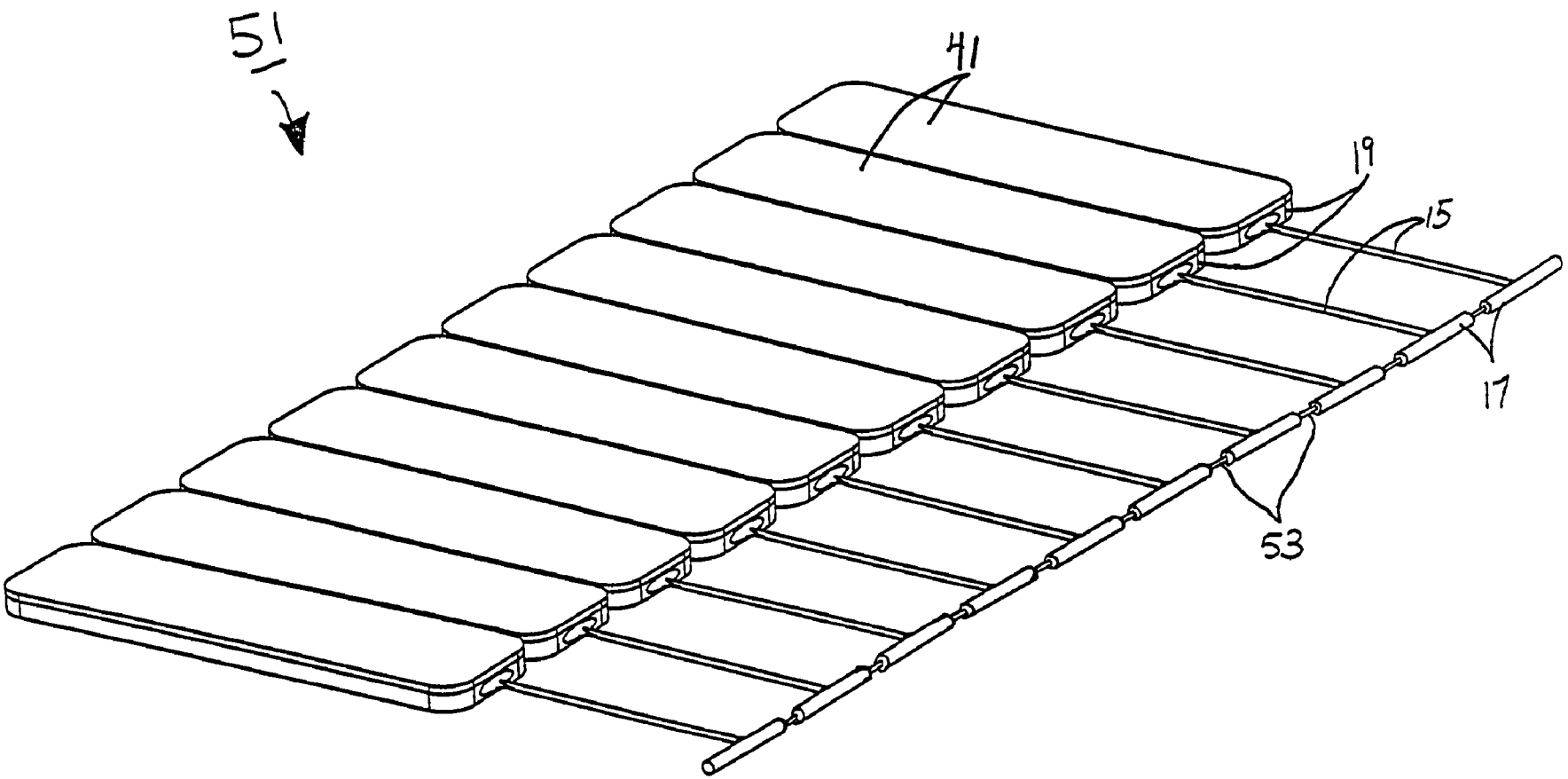
FIG. 6 is a top perspective view of a clip comprising a plurality of the EAS markers of FIG. 1.
Figure 7:
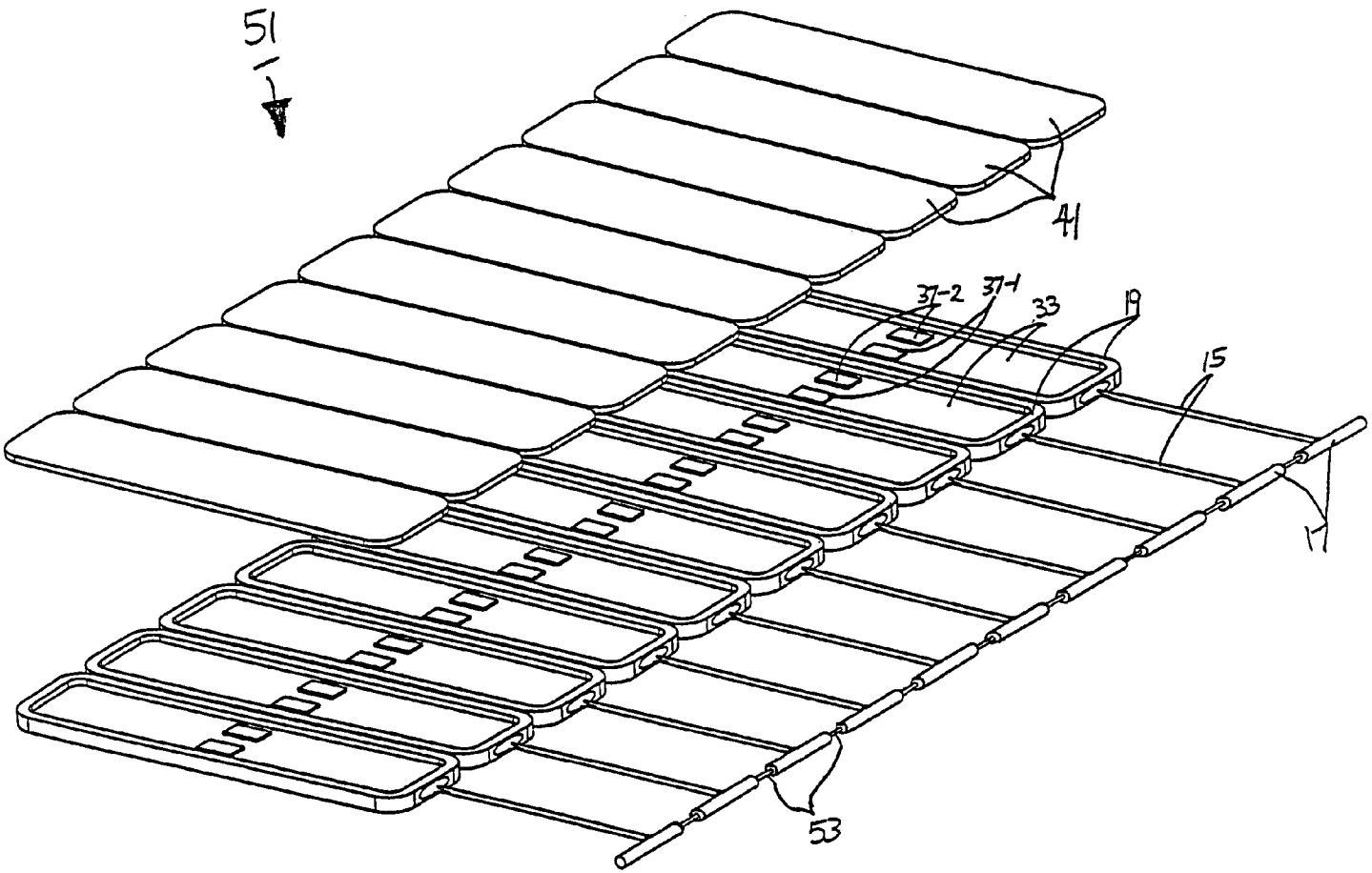
FIG. 7 is a partially exploded perspective view of the clip of FIG. 6.

Referring now to FIGS. 6 and 7, there are shown various views of a clip comprising a plurality of EAS markers 11, said clip being constructed according to the teachings of the present invention and being represented generally by reference numeral 51.

Clip 51 comprises a plurality of EAS markers 11 arranged in an end-to-end fashion with respect to transverse bars 17. Clip 51 also comprises severable connectors 53 for interconnecting adjacent transverse bars 17. Adjacent paddles 19 are not interconnected. The plastic fasteners 13 of clip 51 may be made by index molding, with gating being through paddles 19 via an interconnected runner outboard of the paddle (not shown). Stretching of the filaments 15 could be done in-line, one cavity length at a time (a cavity defining, for example, four to eight interconnected fasteners). Cover 41 could also be made by index molding. Assembly of clip 51 could be automated using lengths of index-molded fasteners 13 and covers 41, together with strips of the biasing element 31, separator 33 and resonator 35.

It should be understood that, instead of making interconnected fasteners 13 of clip 51 by index molding, as mentioned above, one could form an interconnected plurality of similar fasteners by a continuous rotary extrusion technique of the type described in U.S. Pat. No. 5,949,336. (An example of the resulting fastener is shown in FIGS. 3 and 4 of U.S. Pat. No. 5,949,336.)

Figure 8:
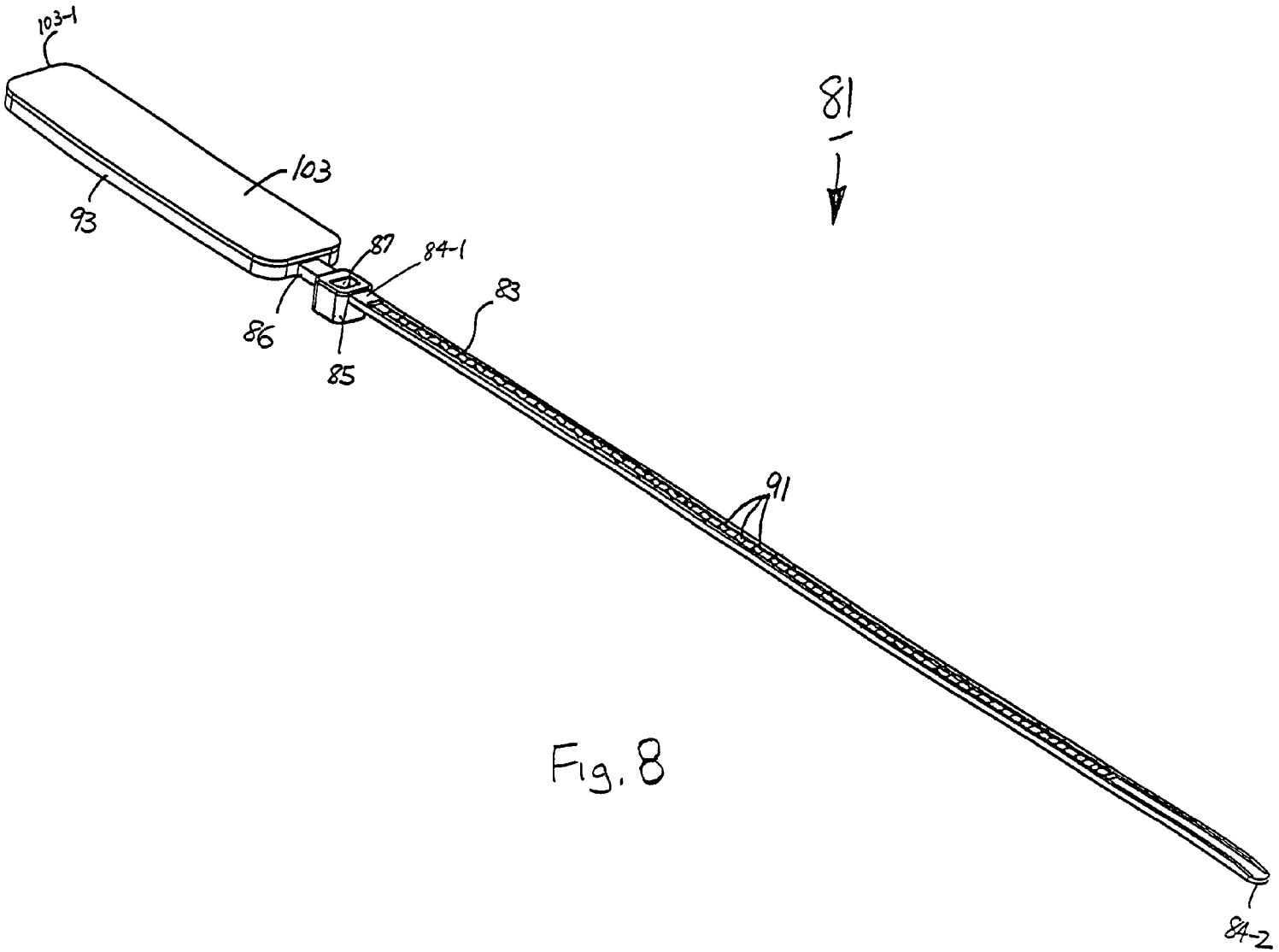
FIG. 8 is a top perspective view of a second embodiment of an EAS marker constructed according to the teachings of the present invention.
Figure 9:
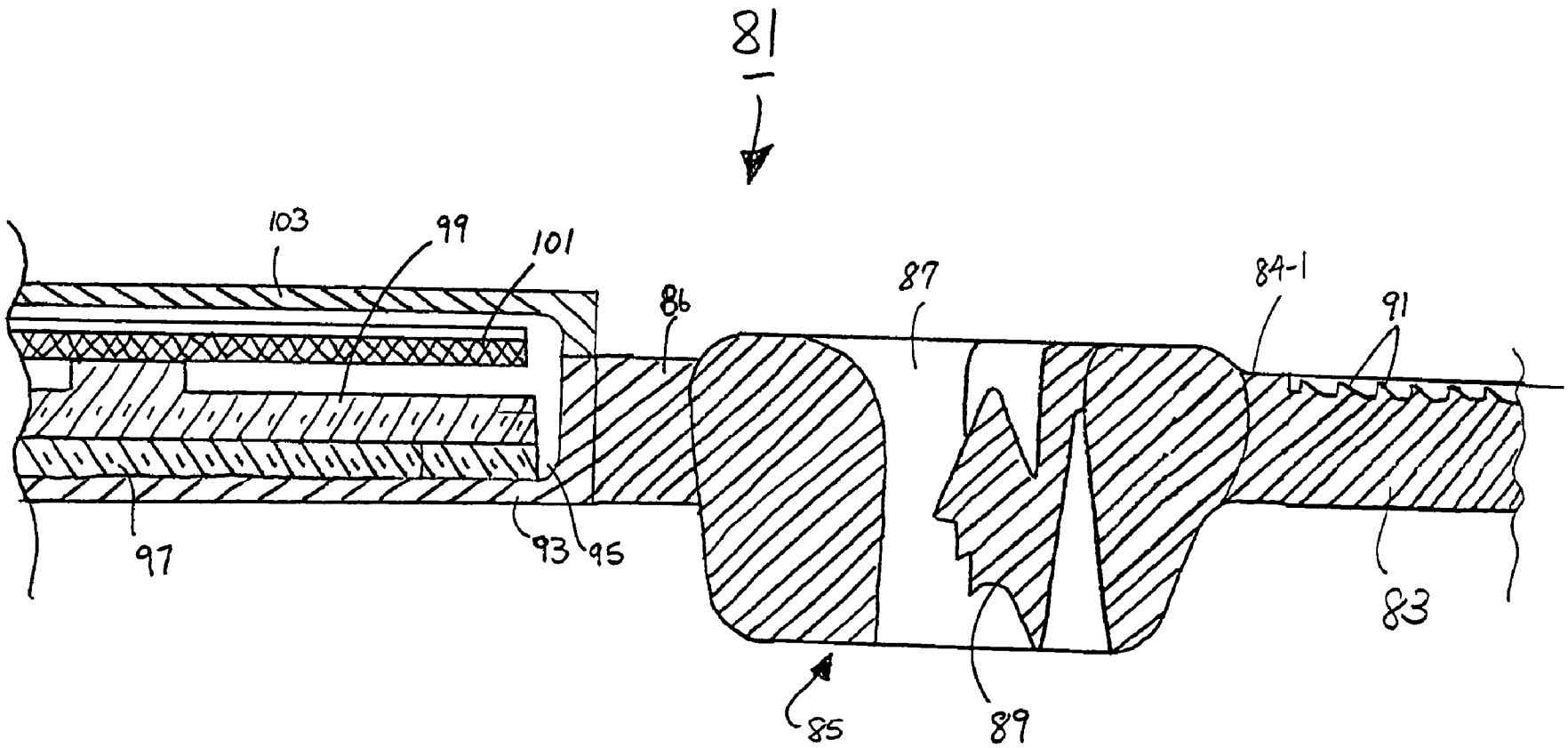
FIG. 9 is a fragmentary longitudinal section view of the EAS marker of FIG. 8.

Referring now to FIGS. 8 and 9, there are shown various views of a second embodiment of an EAS marker constructed according to the teachings of the present invention, said second embodiment of an EAS marker being represented generally by reference numeral 81.

Marker 81 comprises a cable tie, said cable tie comprising an elongated strap 83 having a first end 84-1 and a second end or tail 84-2. A locking head 85 is disposed at first end 84-1 of strap 83, locking head 85 having a channel 87 through which tail 84-2 may be inserted. Channel 87 also has a tang 89 for lockably engaging a selected tooth 91 formed on elongated strap 83 to form a loop of fixed size in the conventional manner. Tang 89 and teeth 91 are conventional in structure, and the number of teeth 91 shown formed on strap 83 is merely illustrative. (Instead, of teeth 91, strap 83 may have a conventional ladder-type shape adapted to engage tang 89.)

A paddle 93 is connected to locking head 85 by a spacer 86, paddle 93 being a trough-shaped member having a recess 95. Paddle 93 and recess 95 are identical in size and shape to paddle 19 and recess 21, respectively, of marker 11. The longitudinal axis of paddle 93 is collinear with the longitudinal axis of strap 83.

Preferably, paddle 93, spacer 86, locking head 85 and strap 83 are formed as a unitary structure made of molded plastic.

Marker 81 further comprises a biasing element 97, a separator 99, and a resonator 101, biasing element 97, separator 99 and resonator 101 being identical to biasing element 31, separator 33 and resonator 35, respectively, of marker 11 and being disposed within recess 95 in an analogous fashion to that of marker 11.

Marker 81 further comprises a cover 103, cover 103 being identical to cover 41 of marker 11 and being secured to paddle 93 in the same manner in which cover 41 is secured to paddle 19 so as to securely encapsulate within recess 95 the combination of biasing element 97, separator 99 and resonator 101. Biasing element 97, separator 99 and resonator 101 are encapsulated only by cover 103 and paddle 93.

Although, in the present embodiment, cover 103 and paddle 93 are shown as two separate pieces which are secured in the manner described above, it can readily be appreciated that cover 103 and paddle 93 could be formed as a unitary structure, with end 103-1 of cover 103 being hingedly interconnected to the end of paddle 93 distal to tail 84-2. In this manner, cover 103 may be pivoted away from paddle 93 while biasing element 97, separator 99 and resonator 101 are loaded into recess 95; thereafter, cover 103 may be pivoted into contact with paddle 93 and secured thereto in the manner described above. It should also be understood that cover 103, instead of paddle 93, may be coupled to locking head 85 by spacer 86.

Marker 81 is intended to be attached to articles of commerce in the same manner as a typical cable tie and, thereafter, is intended to be used in the same fashion as a conventional magnetomechanical EAS marker.

In another embodiment (not shown), spacer 86 is eliminated and locking head 85 is incorporated into paddle 93.

Referring now to FIGS. 10 through 14, there are shown various views of a third embodiment of an EAS marker constructed according to the teachings of the present invention, said third embodiment of an EAS marker being represented generally by reference numeral 101.

Figure 15:
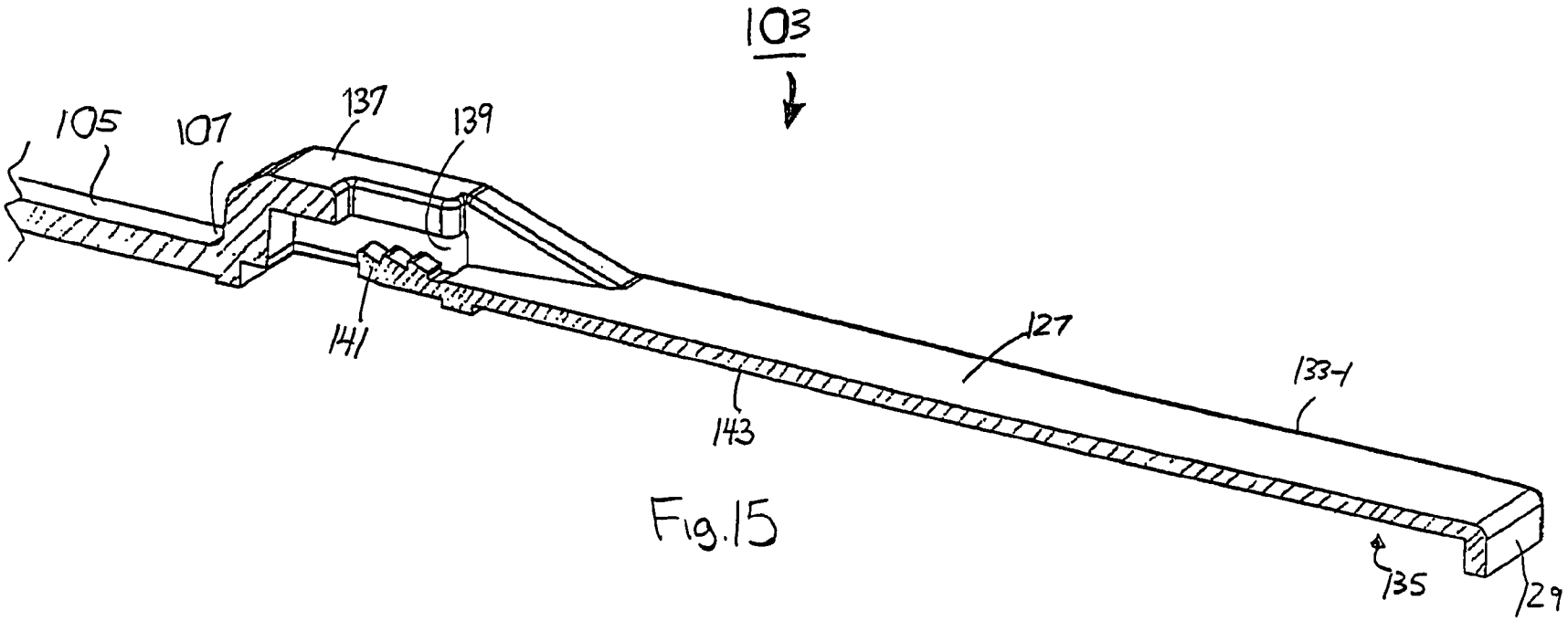
FIG. 15 is an enlarged fragmentary longitudinal section view of the self-lockable loop fastener shown in FIG. 10, illustrating details of the paddle thereof.
Figure 16:
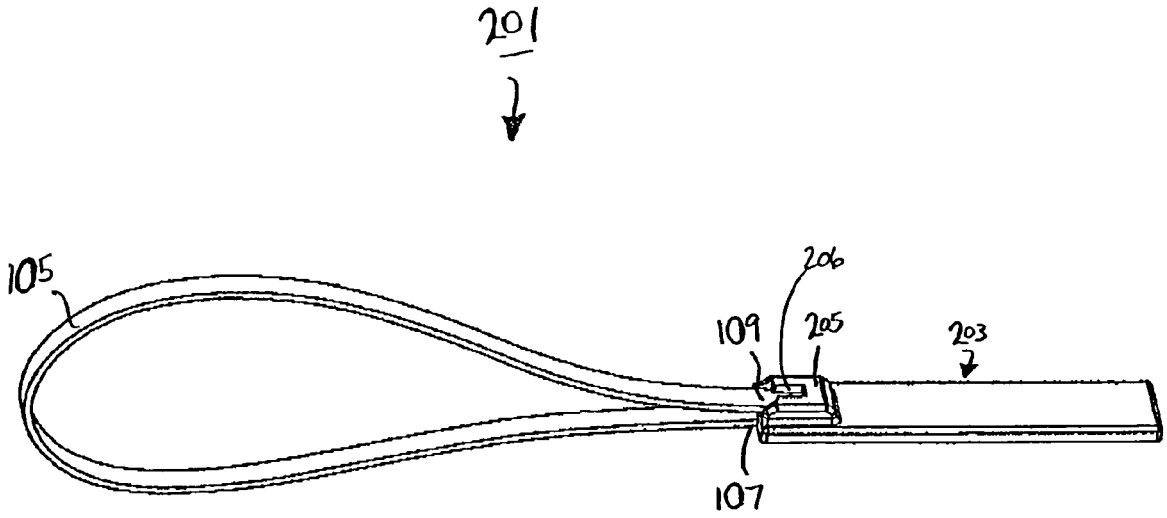
FIG. 16 is a top perspective view of a fourth embodiment of an EAS marker constructed according to the teachings of the present invention, said EAS marker being shown in a locked looped state.
Figure 17:
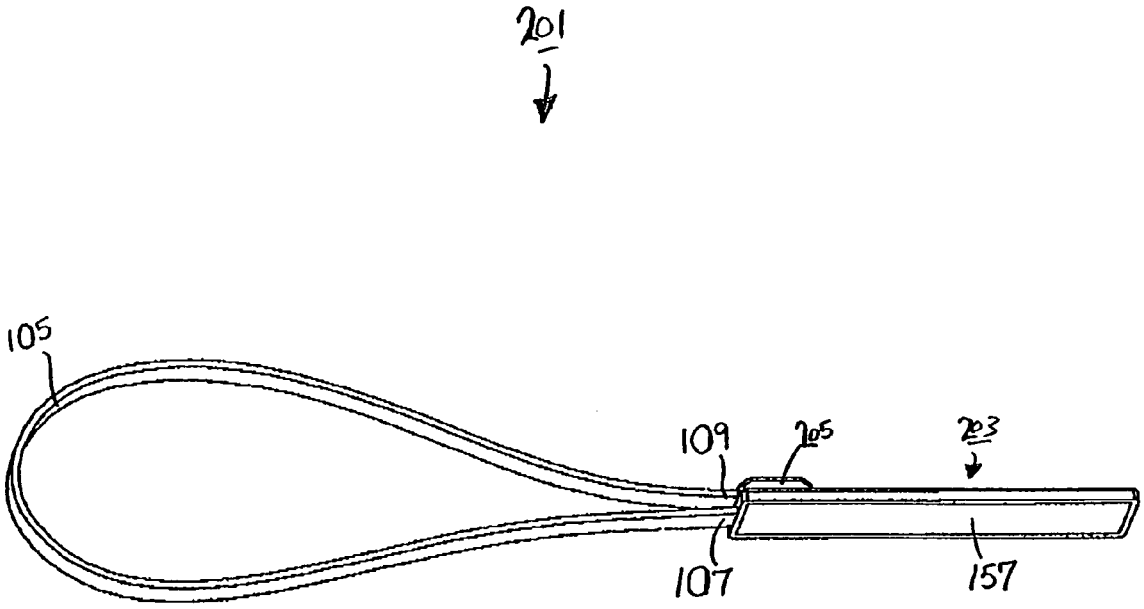
FIG. 17 is a bottom perspective view of the EAS marker of FIG. 16, said EAS marker being shown in a locked loop state.
Figure 18:
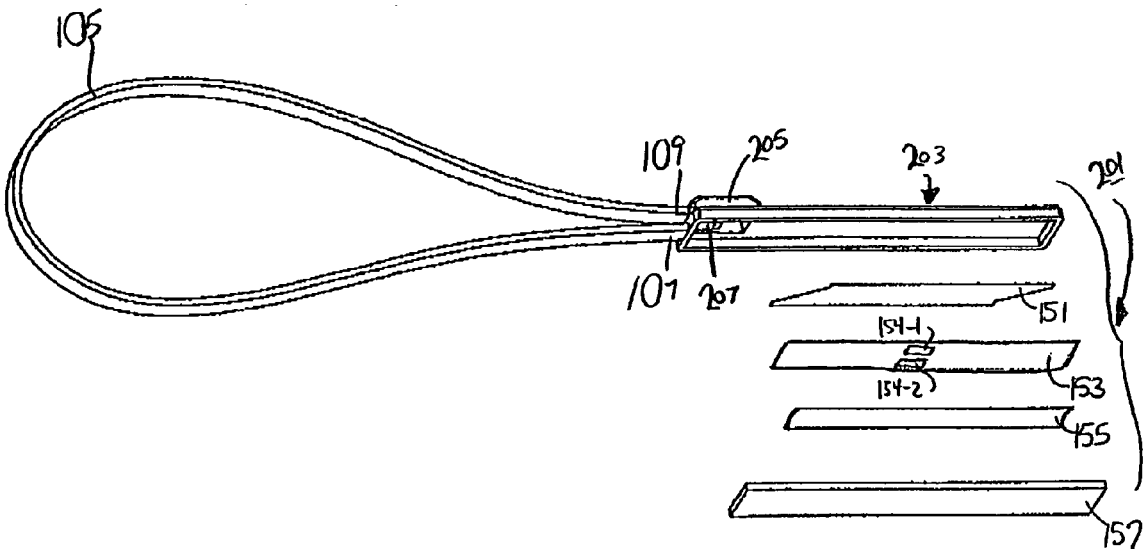
FIG. 18 is an exploded bottom perspective view of the EAS marker of FIG. 16, said EAS marker being shown in a locked loop state.
Figure 19:
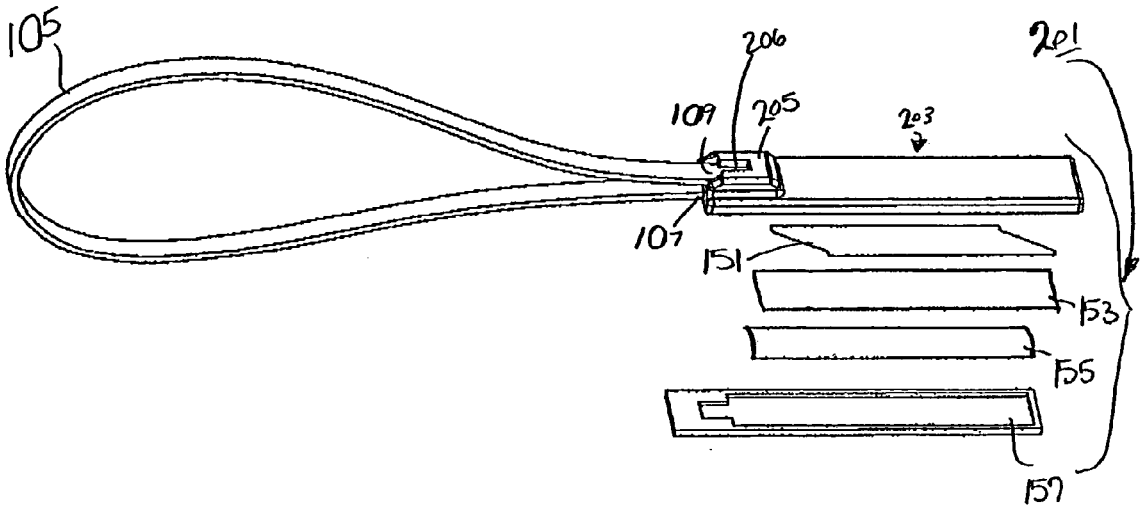
FIG. 19 is an exploded top perspective view of the EAS marker of FIG. 16, said EAS marker being shown in a locked loop state.

Marker 101 comprises a self-lockable loop fastener 103 (self-lockable loop fastener 103 being shown separately in FIG. 15). Fastener 103, which is preferably a unitary structure made of molded plastic, comprises an elongated flexible strap 105, strap 105 having a first end 107 and a second end 109. As seen best in FIG. 14, the top surface of strap 105, proximate to second end 109, is provided with a projection 121 and the bottom surface of strap 105, proximate to second end 109, is provided with a plurality of teeth 123. Teeth 123 are similar in size and shape to the teeth commonly found at the tail end of a strap of a conventional cable tie. The functions of projection 121 and teeth 123 will become apparent below.

Referring now to FIGS. 10 through 15, fastener 103 also comprises a paddle 125, paddle 125 being attached to first end 107 of strap 105. Paddle 125 is a generally rectangularly-shaped member having a top wall 127, a front wall 129, a rear wall 131, a pair of side walls 133-1 and 133-2 and an open bottom 135. A locking head 137 is integrally formed on paddle 125 proximate to rear wall 131, locking head 137 being closed at its rear end but having a slotted opening 139 extending longitudinally (relative to paddle 125 and strap 105) rearwardly for a distance from its front end. Locking head 137 and opening 139 are appropriately sized and shaped to permit second end 109 of strap 105 to be inserted into locking head 137 through opening 139. (Because locking head 137 is open at only one end, strap 105 cannot be inserted entirely through locking head 137.) A tang 141 is pivotally mounted within locking head 137 and is engageable with teeth 123 on strap 105 in such a way as to prevent withdrawal of strap 105 from locking head 137 once teeth 123 have been advanced past tang 141. Projection 121, which is appropriately sized and shaped to be engageable with locking head 137, serves to ensure that teeth 123 are brought into proximity with tang 141. In view of the above, as can readily be appreciated, once teeth 123 have been advanced past tang 141, strap 105 cannot be withdrawn from locking head 137; moreover, due to locking head 137 being open at only one end, since strap 105 cannot be inserted entirely through locking head 137, advancement of teeth 123 past tang 141 results in a locked loop.

Figure 10:
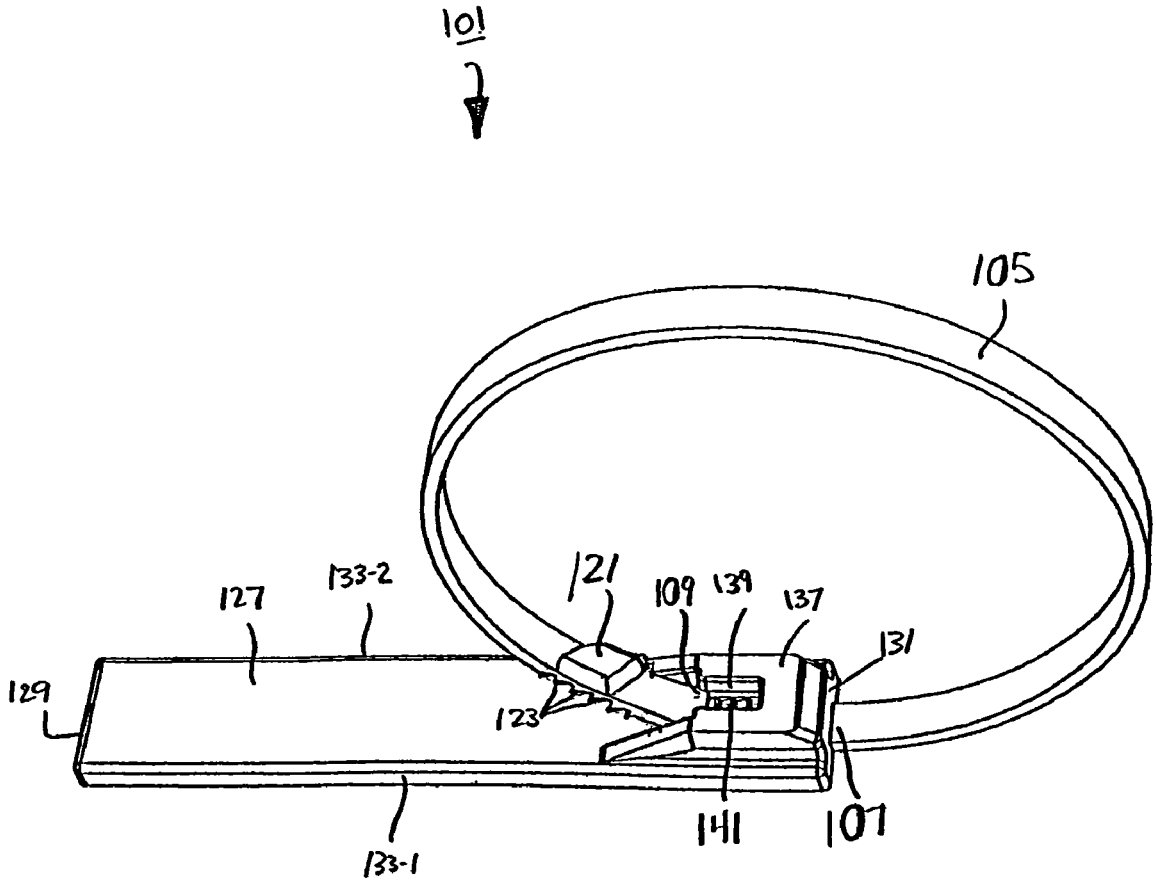
FIG. 10 is a top perspective view of a third embodiment of an EAS marker constructed according to the teachings of the present invention, said EAS marker being shown in a looped but not yet locked state.
Figure 11:
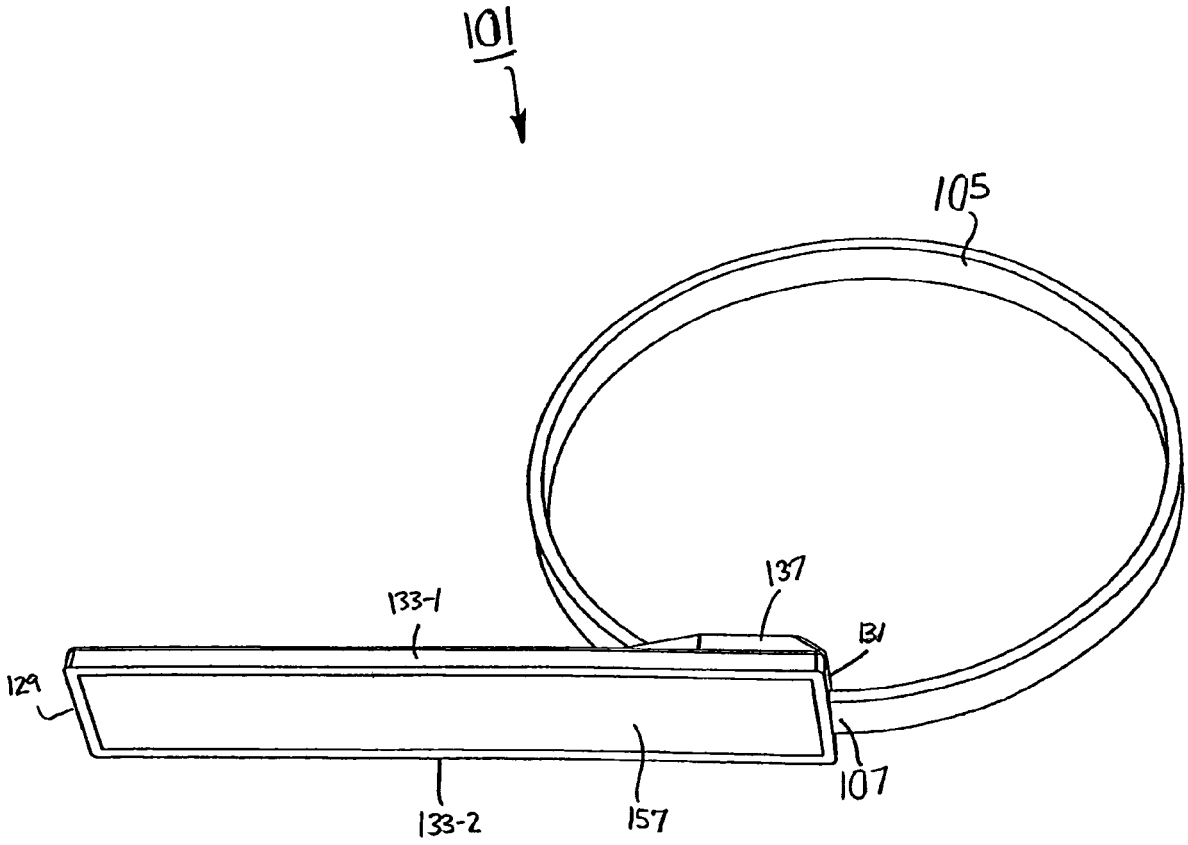
FIG. 11 is a bottom perspective view of the EAS marker of FIG. 10, said EAS marker being shown in a locked loop state.
Figure 12:
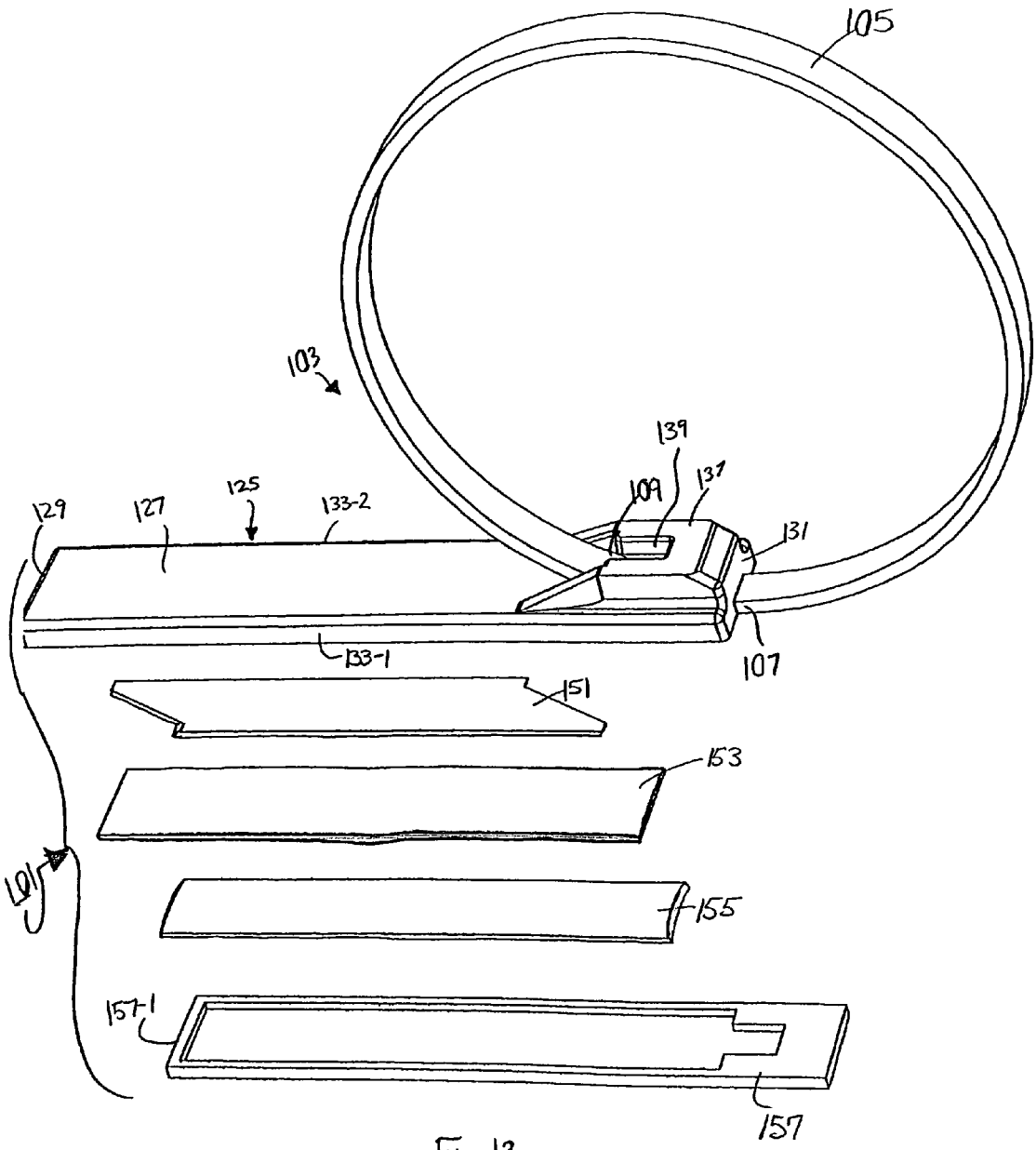
FIG. 12 is an exploded top perspective view of the EAS marker of FIG. 10, said EAS marker being shown in a locked loop state.

As seen best in FIGS. 10, 12 and 15, opening 139 is widest at its entrance (the front end of locking head 137) to facilitate insertion of strap 105 thereinto.

Figure 13:
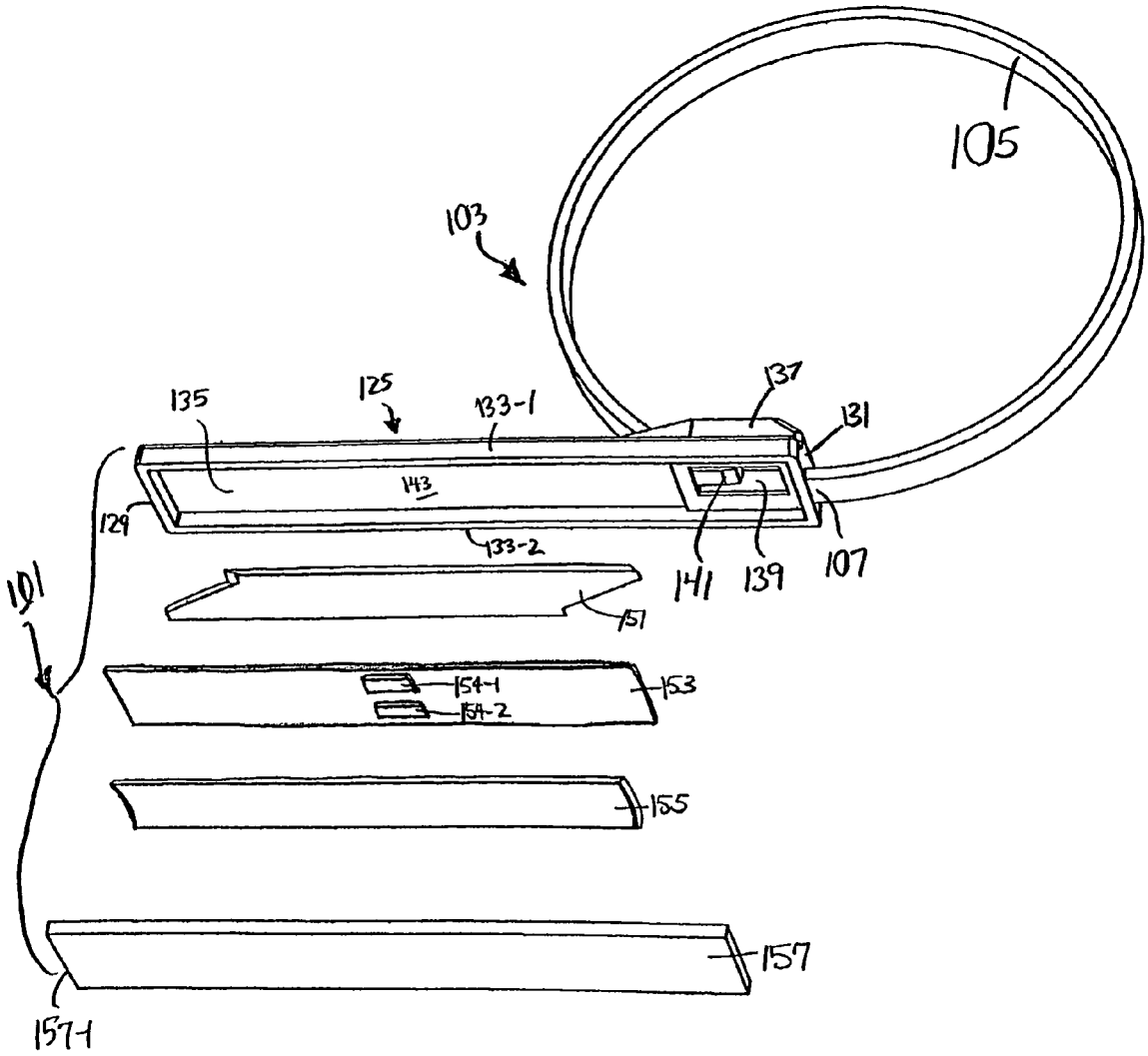
FIG. 13 is an exploded bottom perspective view of the EAS marker of FIG. 10, said EAS marker being shown in a locked loop state.
Figure 14:
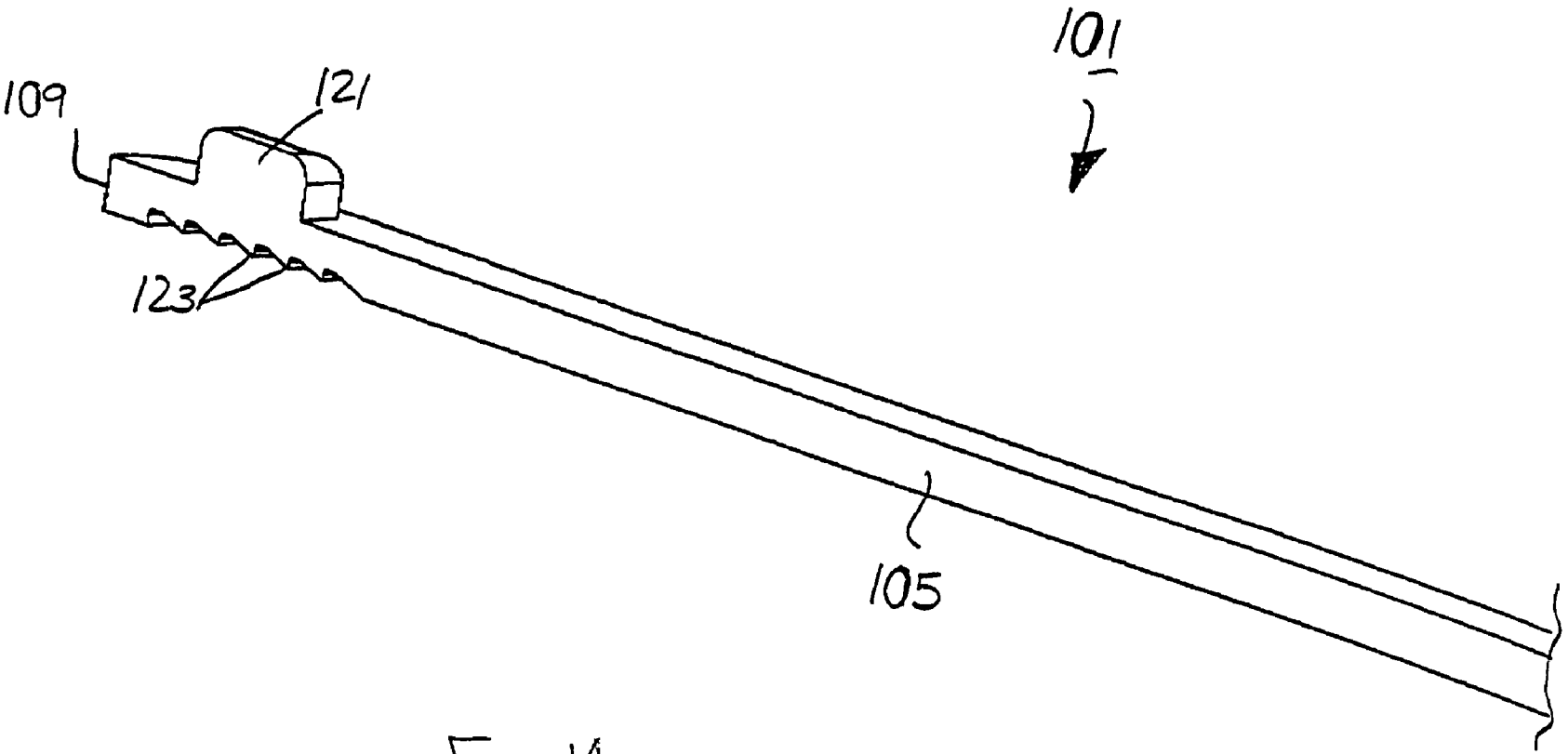
FIG. 14 is an enlarged fragmentary perspective view of the EAS marker of FIG. 10, showing details of the second end of the elongated strap of the self-lockable loop fastener.

Referring now to FIGS. 13 and 15, paddle 125 can be seen to also be shaped to include a downwardly-facing recess or compartment 143 situated in front of the majority of locking head 137. The function of compartment 143 will become apparent from the discussion below.

Referring now to FIGS. 12 and 13, marker 101 also comprises a biasing element 151, a separator 153, and a resonator 155, all of which are disposed within compartment 143, with biasing element 151 being positioned directly in contact with the bottom surface of top wall 127, separator 153 being positioned directly on top of biasing element 151 and resonator 155 being positioned directly on top of separator 153. Biasing element 151 and resonator 155 are preferably conventional in structure and composition and may be identical to biasing element 31 and resonator 35 of marker 11. Separator 153 is identical in structure and composition to separator 33 of marker 11.

Marker 101 further comprises a cover 157, cover 157 being made of a material similar in composition to that used to make fastener 103. Cover 157 is secured to paddle 125 in such a way as to securely encapsulate within compartment 143 the combination of biasing element 151, separator 153 and resonator 155 and to prevent unauthorized access to and tampering with locking head 137 and tang 141 from below. In the present embodiment, cover 157 is secured to paddle 125 by ultrasonic welding, but it can readily be appreciated that cover 157 may alternatively be secured to paddle 125 by a suitable adhesive, by a frictional or interlocking fit or by any other suitable method. Cover 157 and paddle 125 are preferably made of a sufficiently rigid material to protect the contents of compartment 143 since biasing element 151, separator 153 and resonator 155 are encapsulated only by cover 157 and paddle 125. Cover 157 is preferably sufficiently opaque to conceal the contents of compartment 143 for security purposes. The bottom surface of cover 157 may be imprinted with labeling information for commercial purposes or a label may be affixed to the bottom surface of cover 157.

Although, in the present embodiment, cover 157 and paddle 125 are shown as two separate pieces which are secured in the manner described above, it can readily be appreciated that cover 157 and paddle 125 could be formed as a unitary structure, with end 157-1 of cover 157 being hingedly interconnected to wall 129 of paddle 125. In this manner, cover 157 may be pivoted away from paddle 125 while biasing element 151, separator 153 and resonator 155 are loaded into compartment 143; thereafter, cover 157 may be pivoted into contact with paddle 125 and secured thereto in the manner described above.

Marker 101 is intended to be attached to articles of commerce in the same manner as a typical self-lockable loop fastener and, thereafter, is intended to be used in the same fashion as a conventional magnetomechanical EAS marker.

Referring now to FIGS. 16 through 19, there are shown various views of a fourth embodiment of an EAS marker constructed according to the teachings of the present invention, said EAS marker being represented generally by reference numeral 201.

Marker 201 is similar in virtually all respects to marker 101, the principal difference between the two markers being that marker 201 includes a paddle 203 whose locking head 205 and tang 207 are oriented 180 degrees relative to locking head 137 and tang 141, respectively, of marker 101. In other words, the slotted opening 206 of head 205 extends longitudinally (relative to paddle 203 and strap 105) a short distance from the open rear end of head 205 towards the closed front end of head 205.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. An EAS marker comprising:

(a) a cable tie, said cable tie comprising (i) an elongated strap having a first end and a second end, (ii) a locking head disposed at said first end, said locking head having a channel through which said second end of said elongated strap may be inserted and having a tang for lockably engaging said elongated strap, and (iii) a paddle coupled to and spaced from said locking head;

(b) a cover secured to said paddle, said cover and said paddle jointly defining a compartment; and (c) an EAS device disposed within said compartment.

2. The EAS marker as claimed in claim 1 wherein said EAS device comprises a resonator disposed within said compartment for emitting, when armed, a response signal in response to an interrogation signal transmitted by an EAS system, a biasing element disposed within said compartment and positioned relative to said resonator so that, when said biasing element is magnetized, said resonator is armed, and a separator disposed within said compartment between said resonator and said biasing element for physically separating said resonator and said biasing element.

3. The EAS marker as claimed in claim 2 wherein said resonator, said separator and said biasing element are encapsulated within said compartment only by said paddle and said cover.

4. The EAS marker as claimed in claim 1 wherein said paddle is trough-shaped.

5. The EAS marker as claimed in claim 4 wherein said cover is trough-shaped.

6. The EAS marker as claimed in claim 1 wherein said paddle and said cover are sealed together by ultrasonic welding.

7. The EAS marker as claimed in claim 1 wherein one end of said paddle and one end of said cover are interconnected by a hinge.

8. The EAS marker as claimed in claim 1 wherein said separator has a pair of projections facing towards said resonator.

9. The EAS marker as claimed in claim 1 wherein said strap is shaped to include a plurality of teeth, said teeth being lockably engageable with said tang.

10. The EAS marker as claimed in claim 1 wherein said strap has a length and wherein said channel of said locking head is transverse to said length.

11. The EAS marker as claimed in claim 10 wherein said paddle, said spacer, said locking head and said strap form a unitary structure.

12. A cable tie comprising:

(a) an elongated strap having a first end and a second end, (b) a locking head disposed at said first end, said locking head having a channel through which said second end of said elongated strap may be inserted and having a tang for lockably engaging said elongated strap, and (c) a paddle coupled to said locking head, said locking head being positioned between said paddle and said strap.

13. The cable tie as claimed in claim 12 wherein said strap has a length and wherein said channel of said locking head is transverse to said length.

14. The cable tie as claimed in claim 12 wherein said paddle is collinear with said strap.

15. An EAS marker comprising:

(a) a self-lockable loop fastener, said self-lockable loop fastener comprising (i) an elongated strap having a first end and a second end, said second end being provided with an engageable member, (ii) a paddle disposed at said first end of said elongated strap, said paddle having a locking head, said second end of said elongated strap being insertable into, but not through, said locking head, said locking head having means for lockably engaging said engageable member on said elongated strap so as to form a locked loop of fixed size;

(b) a cover secured to said paddle, said cover and said paddle jointly defining a compartment; and (c) an EAS device disposed within said compartment.

16. The EAS marker as claimed in claim 15 wherein said EAS device comprises a resonator disposed within said compartment for emitting, when armed, a response signal in response to an interrogation signal transmitted by an EAS system, a biasing element disposed within said compartment and positioned relative to said resonator so that, when said biasing element is magnetized, said resonator is armed, a separator disposed within said compartment between said resonator and said biasing element for physically separating said resonator and said biasing element.

17. The EAS marker as claimed in claim 15 wherein said engageable member on said strap comprises a tooth and wherein said lockably engaging means comprises a tang lockably engageable with said tooth so as to prevent withdrawal of said tooth past said tang once inserted thereacross.

18. The EAS marker as claimed in claim 17 wherein said locking head has a first end and a second end, said first end being provided with an opening into which said second end of said strap may be inserted, said second end of said locking head being closed.

19. The EAS marker as claimed in claim 18 wherein said opening extends parallel to the length of said strap.

20. The EAS marker as claimed in claim 19 wherein said first end of said locking head faces towards said first end of said strap.

21. The EAS marker as claimed in claim 19 wherein said first end of said locking head faces away from said first end of said strap.

22. The EAS marker as claimed in claim 17 wherein said strap further comprises means for urging said tooth towards said tang when said second end of said strap is inserted into said locking head.

23. The EAS marker as claimed in claim 22 wherein said urging means comprises a projection formed on said strap opposite to said tooth.

24. A self-lockable loop fastener comprising:

(a) an elongated strap having a first end and a second end, said second end being provided with an engageable member, and (b) a locking head coupled to said first end of said elongated strap, said second end of said elongated strap being insertable into, but not through, said locking head, said locking head having means for lockably engaging said engageable member on said elongated strap so as to form a locked loop of fixed size.

25. The self-lockable loop fastener as claimed in claim 24 wherein said engageable member on said strap comprises a set of teeth and wherein said lockably engaging means comprises a tang lockably engageable with a tooth so as to prevent withdrawal of said tooth past said tang once inserted thereacross.

26. The self-lockable loop fastener as claimed in claim 25 wherein said locking head has a first end and a second end, said first end being provided with an opening into which said second end of said strap may be inserted, said second end of said locking head being closed.

27. The self-lockable loop fastener as claimed in claim 26 wherein said opening extends parallel to the length of said strap.

28. The self-lockable loop fastener as claimed in claim 27 wherein said strap further comprises means for urging said teeth towards said tang when said second end of said strap is inserted into said locking head.

29. The self-lockable loop fastener as claimed in claim 28 wherein said urging means comprises a projection formed on said strap opposite to said tooth.

30. The self-lockable loop fastener as claimed in claim 27 wherein said first end of said locking head faces towards said first end of said strap.

31. The self-lockable loop fastener as claimed in claim 27 wherein said first end of said locking head faces away from said first end of said strap.

* * * * *